United States Patent [19]

Reichenbach

[11] Patent Number: 4,711,210

[45] Date of Patent: Dec. 8, 1987

[54] COMPRESSION BRAKING SYSTEM FOR AN INTERNAL COMBUSTION ENGINE

[75] Inventor: Dean H. Reichenbach, Columbus, Ind.

[73] Assignee: Cummins Engine Company, Inc., Columbus, Ind.

[21] Appl. No.: 946,815

[22] Filed: Dec. 29, 1986

[51] Int. Cl.[4] ..... F02D 13/04

[52] U.S. Cl. ..... 123/321; 123/90.46

[58] Field of Search ..... 123/320–322, 123/90.15, 90.16, 90.45, 90.46

[56] References Cited

U.S. PATENT DOCUMENTS

| | | | |
|---|---|---|---|
| 2,791,206 | 5/1957 | Engemann | 123/90.45 |
| 3,547,087 | 12/1970 | Siegler | 123/321 |
| 3,572,300 | 3/1971 | Stager et al. | 123/321 |
| 3,809,033 | 5/1974 | Cartledge | 123/90.46 |

*Primary Examiner*—William A. Cuchlinski, Jr.

*Attorney, Agent, or Firm*—Neuman, Williams, Anderson & Olson

[57] ABSTRACT

A compression braking system for an internal combustion engine is provided which includes a compact housing disposed adjacent the fuel injecting actuating assembly and the exhaust valve actuating assembly for each cylinder of the engine. The housing is provided with a first cavity in which is reciprocally mounted a first piston having one end thereof protruding from one end of the first cavity and being engaged and moved by the fuel injecting actuating assembly. A second cavity is formed in the housing in a proximate angular relation with the first cavity. Reciprocally mounted within the second cavity is a second piston having one end thereof protruding from one end of the second cavity and engaging and moving the exhaust valve actuating assembly to releases compression pressure within the cylinder and provide retarding power when the engine is in the compression braking mode. A third cavity is provided within the housing which forms a linkage passage communicating with corresponding second ends of the first and second cavities. During normal operation of the engine, the linkage passage is substantially void of hydraulic fluid, thus motion of the first piston is not hydraulically transferred to the second piston. When the engine is in a compression braking mode, hydraulic fluid fills the linkage passage thereby causing the motion of the first piston to be hydraulically transferred through the linkage passage to the second piston and effect movement of the exhaust valve actuating assembly.

6 Claims, 5 Drawing Figures

COMPRESSION BRAKING SYSTEM FOR AN INTERNAL COMBUSTION ENGINE

BACKGROUND OF THE INVENTION

Compression braking of an internal combustion engine is a well known concept for enhancing the braking effect of conventional braking systems incorporated in heavy duty trucks, buses and the like. It has been found that the utilization of compression braking significantly reduces wear and stress on the conventional braking system and thus, reduces the incidents of failure of such braking systems. Various compression braking systems have heretofore been utilized; however, because of certain design characteristics, they have been beset with one or more of the following shortcomings: (a) an inordinate number of components are required thereby significantly increasing the complexity and initial cost of the system; (b) the system requires a large and sophisticated hydraulic network; (c) certain of the system components are subjected to severe moment and horizontal reaction forces thereby, resulting in components being bulky and thick in order to withstand such forces; (d) portions of the engine block and head must be redesigned or significantly modified to accommodate the compression braking system; (e) an inordinate amount of space is required to house an engine with a prior compression braking system mounted thereon; (f) the compression braking system is unreliable and requires frequent servicing and adjusting; (g) various components of the system require precise fitting and thus close manufacturing tolerances in order for the system to be in proper working order; and (h) installation of the compression braking system on the engine block or cylinder head is a time-consuming, awkward and difficult operation.

SUMMARY OF THE INVENTION

Thus, it is an object of the invention to provide a compression braking system which overcomes the aforementioned shortcomings of the prior systems.

It is a further object to provide a compression braking system having a simple, compact housing wherein no excessive or abnormal moment or horizontal reaction forces are created therein when the engine is in the compression braking mode.

It is a further object to provide a compression braking system which may be utilized in either in-line or V-type engines or in single or multiple cylinder head engines.

Further and additional objects will appear from the description, accompanying drawing and appended claims.

In accordance with one embodiment of the invention, a compression braking system for an internal combustion engine is provided having a compact housing which is adapted to be disposed proximate the fuel injecting actuating assembly and the exhaust valve actuating assembly provided for each cylinder of the engine. The housing includes a first cavity in which is reciprocally mounted a first piston. One end of the first piston protrudes from one end of the cavity and is engaged and moved inwardly by the fuel injecting actuating assembly. A second cavity is formed in the housing and is in angular proximate relation with the first cavity. Reciprocally mounted within the second cavity is a second piston having one end protruding from one end of the second cavity and being adapted to engage and move the exhaust valve actuating assembly when the engine is in the compression braking mode. The housing is provided with a third cavity having a section thereof forming a linkage passage interconnecting corresponding second ends of the first and second cavities. Disposed within the third cavity is a connector piece having a portion thereof communicating with an engine circuit through which hydraulic fluid flows. Also mounted within the housing third cavity and disposed between the connector piece and the linkage passage is a check valve. The check valve allows hydraulic fluid to only flow from the circuit into the linkage passage and fill the same with said hydraulic fluid. When the linkage passage is filled with the hydraulic fluid, motion of the first piston is hydraulically transferred to the second piston. Filling of the linkage passage occurs when the engine is in the compression braking mode. During normal operation of the engine, the hydraulic fluid is drained from the linkage passage.

DESCRIPTION

For a more complete understanding of the invention, reference is made to the drawings wherein.

Figure 1:
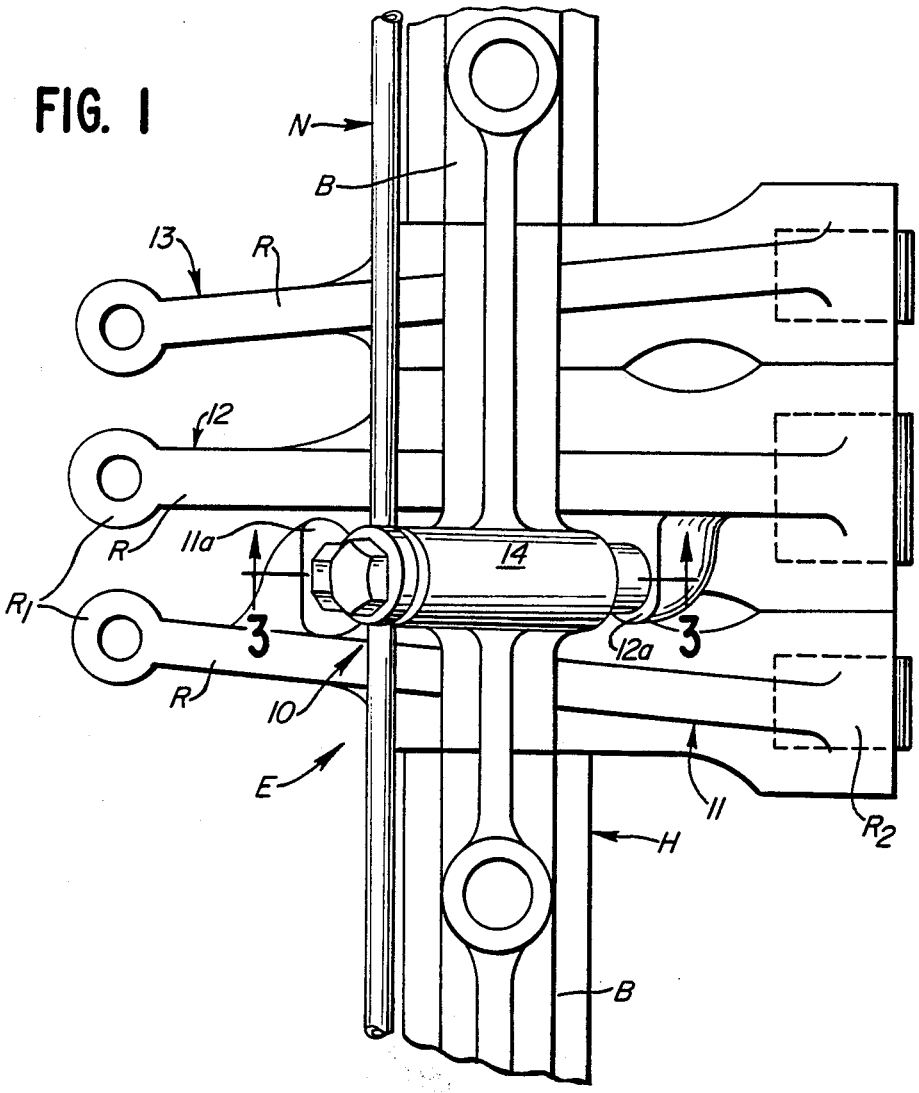
FIG. 1 is a fragmentary top plan view of an internal combustion engine showing one embodiment of the improved compression braking system mounted thereon.

Referring now to the drawings and more particularly to FIG. 1, a preferred embodiment of the improved compression braking system 10 is shown mounted on the cylinder head H of a conventional in-line engine E. While FIG. 1 and FIG. 2, as well, appear to show an overhead camshaft engine it is to be understood that the invention hereinafter described is not intended to be limited thereto but may be incorporated in an engine having a lower mounted camshaft DHR and associated push rods.

The engine as illustrated in FIG. 1 includes an exhaust valve rocker arm assembly 11, a fuel injector rocker arm assembly 12 and an air intake valve rocker arm assembly 13. The three assemblies 11–13 are normally provided for each cylinder, not shown, of the engine. Each assembly includes a rocker arm R which is mounted on the exterior of the cylinder head for pivoting about a fixed axis X which may be located approximately midlength of the arm see FIG. 2. One end $R_2$ of each arm is adapted to be engaged by a camshaft, not shown. The opposite end $R_1$ of each rocker arm is adapted to perform a particular function. In the case of assembly 11, the arm end $R_1$ is adapted to engage the exhaust valves, not shown, mounted adjacent the upper end of the cylinder. The exhaust valves are biased to normally assume a closed position and thus, assembly 11 actuates the exhaust valves to an open position in accordance with a predetermined time sequence. Arm end $R_1$ of assembly 12 is adapted to actuate the fuel injector, not shown, provided for the cylinder. Rocker arm R of assembly 12 would normally be aligned with the centerline of the cylinder. Arm end $R_1$ of assembly 13 is adapted to engage and actuate the air intake valves, not shown, of the cylinder. Normally a pair of exhaust valves and a pair of air intake valves are provided for each cylinder; thus, the arm ends $R_1$ of assemblies 11 and 13 are provided with a suitable bridge which will effect simultaneous operation of the valves comprising each pair.

Figure 2:
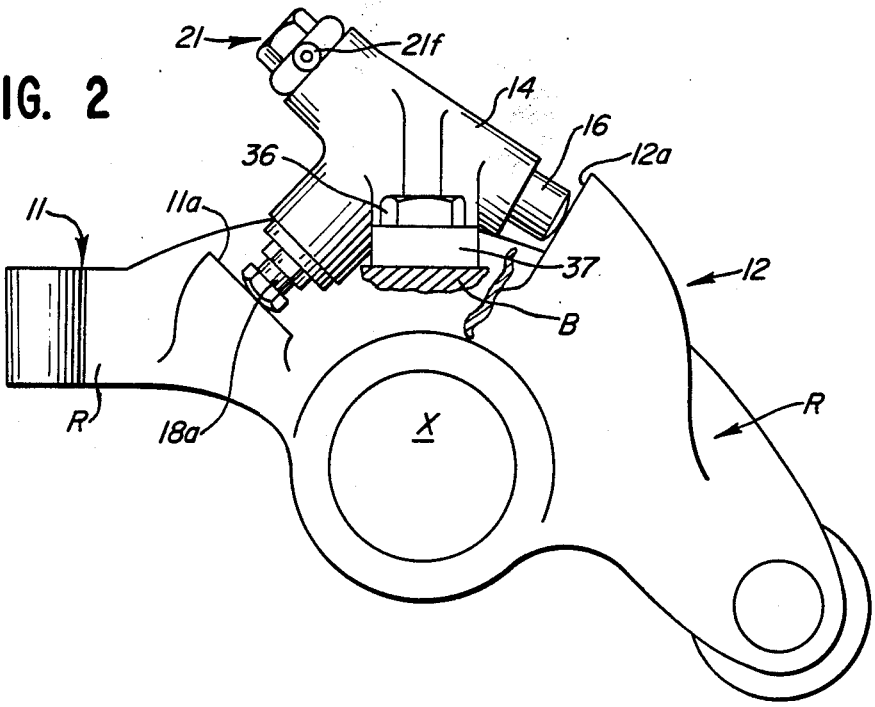
FIG. 2 is an enlarged fragmentary side elevational view of a segment of the compression braking system shown in FIG. 1 with a portion of the fuel injecting actuating assembly removed.
Figure 3:
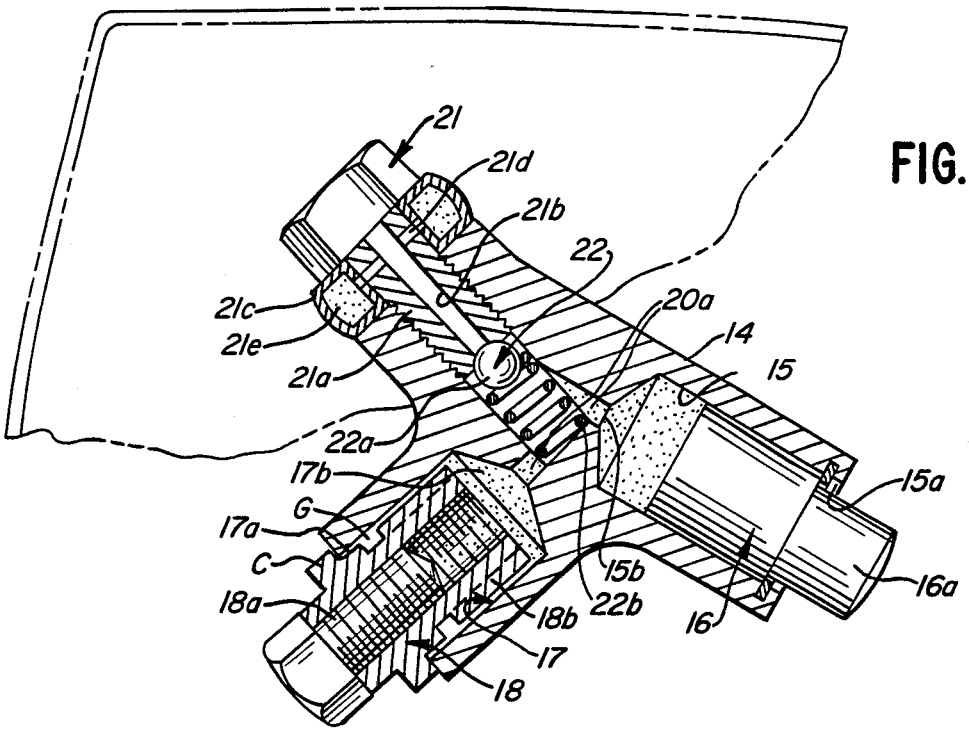
FIG. 3 is a fragmentary sectional view taken along line 3—3 of FIG. 1.

As seen in FIG. 2 and 3, the compression braking system 10 includes a compact housing 14 which is mounted on a rocker shaft support B formed on head H. The housing is sized so that it may be readily located between the arms R of assemblies 11,12 without obstructing movement thereof. Housing 14 is provided with a first cavity 15 in which is reciprocally mounted a first piston 16 sometimes referred to as the master piston. One end 16*a* of the piston protrudes from one end 15*a* of cavity 15 and is adapted to be engaged by a lateral projection 12A formed on the side of the rocker arm of assembly 12. Housing 14 is also provided with a second cavity 17 which is disposed at an angular, proximate position with respect to cavity 5. Reciprocally mounted within cavity 17 is a second piston 18, sometimes referred to as the slave piston. Piston 18 has a portion 18*a* thereof which protrudes outwardly from one end 17*a* of cavity 17 and is adapted to engage and push against a lateral projection llA formed on the side of the rocker arm of assembly 11, when the engine is in a compression braking mode, as will be described more fully hereinafter.

As seen in FIG. 3, the protruding piston portion 18*a* is provided with a laterally extending annular collar C which limits the extent to which the piston 18 can be retracted into cavity 17. The portion 18*b* of the piston which projects into cavity 17 is provided with an annular external groove G in which will flow hydraulic fluid when the piston portion is disposed within cavity 17 and the fluid is urging the piston 18 to move outwardly, as will be described more fully hereinafter.

Corresponding inner, or second, ends 15*b*, 17*b* of cavities 15 and 17, respectively, are interconnected by a linkage passage 20*a* which forms a section of a third cavity 20 provided in housing 14. It should be noted that cavity 20 is located between cavities 15 and 17 has mounted at one end 20*b*, a connector piece 21. Piece 21 has an elongated first section 21*a* which is threaded into the cavity end 20*b*. Section 21*a* is provided with a longitudinally extending internal passage or bore 21*b* having an outer end thereof terminating in an exposed second section 21*c*. Section 21*c* is provided with an internal cross passage 21*d* which communicates with the outer end of passage 21*b*. An annular internal passage 21*e*, formed in piece section 21*c*, encompasses cross passage 21*d* and the upper end of passage 21*b* and communicates with opposite ends thereof. Suitable ports 21*f* are provided in the exposed piece section 21*c* for connecting the passage 21*e* to a circuit or network N of the engine through which hydraulic fluid subjected to a predetermined pressure range flows when the engine is operating under normal conditions. The network to be hereinafter described, is diagrammatically shown in FIG. 4.

Positioned within housing cavity 20 and located between linkage passage 20*a* and the concealed end of piece section 21*a* is a ball-type check valve 22. The ball 22*a* of the valve is urged by a spring 22*b* into engagement with a seat which is provided at the end of piece section 21*a* and thus, closes off passage 21*b* except when the hydraulic fluid pressure within network N overcomes for a predetermined time interval, the bias of spring 22*b*. When the ball 22*a* is unseated, hydraulic fluid will completely fill linkage passage 20*a* and the portions of cavities 15 and 17 connected thereto. The unseating hydraulic fluid pressure occurs for the short period of time within the network N when braking of engine is initiated. As the braking action continues, the master piston 16 will be moved by the rocker arm R of assembly 12, which is actuated by the push rod engaging the engine cam shaft. Once the linkage passage is filled with hydraulic fluid and the master piston 16 is beginning to be pushed into the cavity, the pressure within passage 20*a*, coupled with the spring pressure on the ball, will cause the latter to quickly reseat. When this latter condition occurs, the movement of the master piston towards the cavity end 15*b* will be hydraulically transferred to the concealed end of slave piston 18 causing the latter to be pushed outwardly a predetermined amount whereupon the actuating assembly 11 will cause the exhaust valves to open and remain open thereby releasing compression pressure within the engine cylinder and provide retarding power for the engine while the engine remains in the compression braking mode. The slave piston will continue its outward movement in response to the movement of the master piston until the external groove G of piston 18 moves beyond the end 17*a* of cavity 17. Once groove G is exposed, the hydraulic fluid within passage 20*a* will flow out through groove G. There is sufficient clearance between the wall of cavity 17 and the exterior surface of the portion 18*b* of piston 18 disposed between the groove and the end of the piston adjacent the cavity end 17*b*, to allow the fluid to flow to groove G. Thus, the groove placement on the piston exterior determines the limit to which the slave piston 18 can be moved outwardly by the master piston 16.

Once braking of the engine has been discontinued, the fluid within passage 20*a* and the portions of the cavities communicating therewith will drain a sufficient amount of fluid so that there is no longer responsive movement of the slave piston because there is insufficient fluid within the passage to provide a consistent, uniform hydraulic fluid linkage between the two pistons. As the master piston 16 is actuated by the rocker arm of assembly 12, the piston 16 will cause whatever hydraulic fluid remaining in passage 20*a* to substantially drain therefrom in a short period of time.

Figure 4:
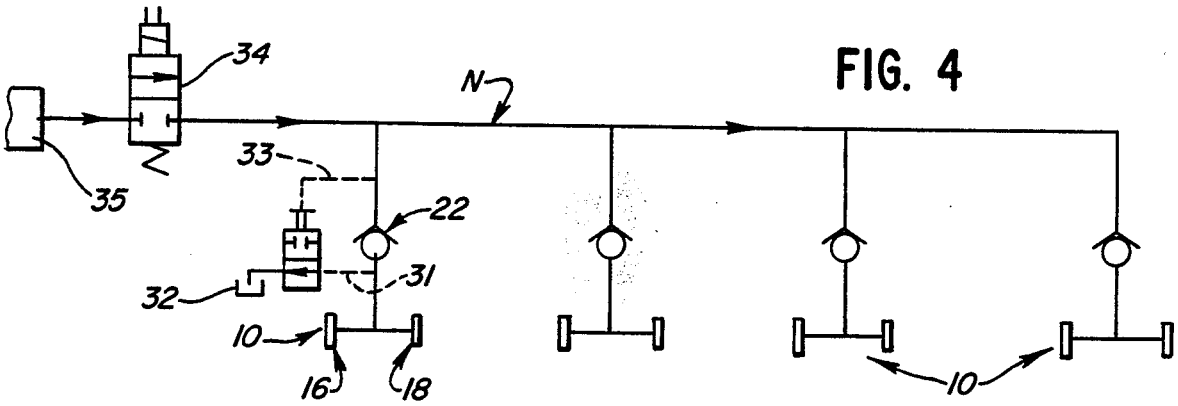
FIG. 4 is a diagrammatic view of the hydraulic fluid network for the compression braking system.
Figure 5:
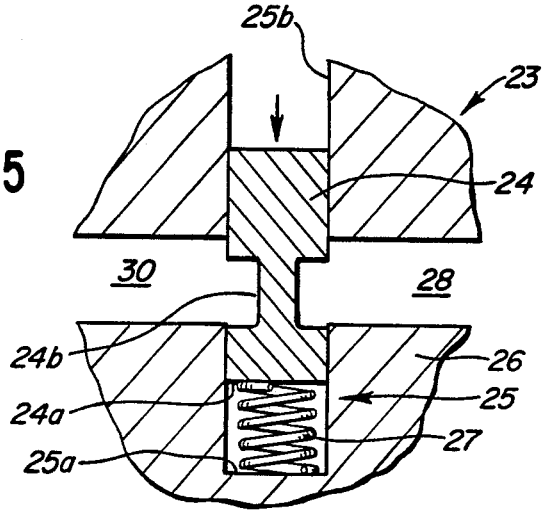
FIG. 5 is an enlarged fragmentary view of a dump valve which is an optional component of the network of FIG. 4.

If a more rapid drainage from the linkage passage is desired, an optional spool-type dump valve 23, see FIGS. 4 and 5 may be utilized. Valve 23, as seen in FIG. 5, is of conventional design and includes a spool or shuttle 24 which is reciprocally mounted within a bore 25 formed in a casing 26. The lower end 25*a* of the bore is closed and is engaged by one end of a coil spring 27. The opposite end of the spring engages the lower end 24*a* of spool 24. Spring 27 biases the spool to assume its normal rest position, as seen in FIG. 5. When in the rest position, an annular groove 24*b* formed on the exterior of the spool is substantially centered with respect to a pair of opposed ports 28,30 formed in casing 26. Port 28 communicates via conduit 31 with the portion of the third cavity 20 located between the check valve ball 22*a* and the linkage passage 20*a*. Port 30 communicates with a sump 32, see FIG. 4. The upper end 25*b* of the bore is connected via conduit 33 to a portion of the network N which is upstream of check valve 22. Thus, when the pressure of the hydraulic fluid in the network N exceeds the bias of spring 27, the spool 24 will be forced towards the bore closed end 25*a* compressing spring 27 and causing the groove 24*b* of the spool to be out of alignment with ports 28,30 and interrupting communication between the third cavity 20 of housing 14 and the sump 32.

The network N, as shown diagrammatically in FIG. 4, includes a solenoid valve control 34 which is located in a segment of the hydraulic fluid circuit between a source 35 of pressurized hydraulic fluid and the compression braking system 10 located in proximate relation to each cylinder of the engine. The control 34 is connected in such a way that when the brake pedal or lever, not shown, is actuated to effect braking, the control 34 will complete the flow circuit between the source 35 and the respective compression braking systems 10. When this occurs, hydraulic fluid pressure will cause the check valve ball 22*a* in each instance to unseat allowing the linkage passage 20*a* to be filled with the required amount of fluid. As forenoted, once the linkage passage is properly filled with hydraulic fluid, motion of the master piston 16 retracting into cavity 15 will be hydraulically transferred to the slave piston 18.

The compactness of housing 14 is accomplished by reason of the relative locations of the cavities 15, 17 and 20. The angled disposition of the master and slave pistons results in the horizontal or transverse components of the forces generated within the housing by the pistons cancelling one another leaving only a vertical or aligned component which is effectively resisted by anchor bolts 36. Furthermore, the lines of motion of the pistons 16,18 are spaced sufficiently from points of attachment of the housing 14 to the support B that the moments produced by such piston movement are cancelled. In FIG. 2, only one anchor bolt 36 is shown which extends through a laterally extending lug 37 formed on the exterior of housing 14, and is threaded into the portion of support B subtending the lug. The housing 14 is normally provided with a pair of diametrically opposed lugs.

While the improved compression braking system has been described in relation to an in-line engine, it is not intended to be limited thereto. Such a system can be readily installed in a V-type engine or in engines having single or multiple heads. The number of cylinders and the horsepower rating of the engine may also vary over a wide range.

I claim:

1. In a multi-cylinder internal combustion engine having fuel injecting means for each cylinder, first actuating means for operating the fuel injecting means, exhaust valve means for each cylinder biased to assume a closed position, and second actuating means for opening the exhaust valve means; a compression braking system comprising a housing for disposition proximate the first and second actuating means of each cylinder, said housing including a first cavity in which a first piston is reciprocally mounted, a portion of said first piston protruding from one end of the first cavity and being engaged and moved by said first actuating means, a second cavity angularly disposed relative to said first cavity and proximate a second end of said first cavity, a second piston reciprocally mounted within said second cavity and having a portion thereof protruding from one end of the second cavity for engaging and moving the second actuating means when the engine is in a compression braking mode, and a third cavity proximate said first and second cavities and having a portion thereof forming a linkage passage interconnecting a second end of the second cavity to the second end of the first cavity; normally closed check valve means disposed within said third cavity; a connector piece having a first section provided with an elongated first passage and disposed within said third cavity and on the opposite side of said check valve means from the linkage passage, and a protruding second section having a second passage communicating with the first passage formed in said first section, said second passage forming a segment of a flow circuit through which hydraulic fluid circulates; during a predetermined engine operating mode, said linkage passage being filled with hydraulic fluid from the flow circuit whereby inward movement of said first piston into the said first cavity is transmitted via the linkage passage hydraulic fluid to said second piston affecting outward movement thereof whereby said second actuating means opens the cylinder exhaust valve means.

2. The compression braking system of claim 1 wherein upon the second piston having moved outwardly relative to the second cavity a predetermined amount further outward movement of said second piston is automatically discontinued.

3. The compression braking system of claim 1 wherein the first piston functions as a master piston and the second piston functions as a slave piston when the engine is in the braking mode and until the second piston has moved a predetermined distance outwardly relative to the second cavity.

4. The compression braking system of claim 2 wherein the second piston has a second portion disposed within said second cavity, said second portion being provided with an external groove in continuous communication with the linkage passageway, when said groove is disposed within said second cavity; said groove being disposed substantially outwardly of said second cavity when said second piston has moved outwardly said predetermined amount whereby further outward movement of said second piston in response to movement of said first piston is discontinued.

5. The compression braking system of claim 4 wherein the protruding portion of the second piston is provided with an exposed external collar impassable relative to the one end of the second cavity.

6. The compression braking system of claim 1 wherein the relative angular proximate locations of the first, second and third cavities within the housing and the directions of movement of the pistons within said first and second cavities effect substantial cancellation of transverse forces generated by said pistons when the engine is operating in the compression braking mode.

* * * * *